US007918674B2

(12) United States Patent
Dufresne de Virel

(10) Patent No.: US 7,918,674 B2
(45) Date of Patent: Apr. 5, 2011

(54) SYSTEM FOR PROTECTING THE ENGAGABLE ELEMENTS OF A CONNECTOR

(75) Inventor: François Dufresne de Virel, Paris (FR)

(73) Assignee: Sagem Defense Securite, Paris (FR)

( * ) Notice: Subject to any disclaimer, the term of this patent is extended or adjusted under 35 U.S.C. 154(b) by 0 days.

(21) Appl. No.: 12/501,042

(22) Filed: Jul. 10, 2009

(65) Prior Publication Data

US 2010/0022110 A1 Jan. 28, 2010

(30) Foreign Application Priority Data

Jul. 24, 2008 (FR) ..... 08 04211

(51) Int. Cl.
*H01R 13/44* (2006.01)

(52) U.S. Cl. ..... 439/138

(58) Field of Classification Search ..... 439/135, 439/136, 138, 139, 271, 272
See application file for complete search history.

(56) References Cited

U.S. PATENT DOCUMENTS

| | | | | |
|---|---|---|---|---|
| 4,217,019 | A | 8/1980 | Cameron | |
| 5,716,224 | A | 2/1998 | Masuda et al. | |
| 5,722,842 | A | 3/1998 | Cairns | |
| 6,520,782 | B2 * | 2/2003 | Mori | 439/138 |

* cited by examiner

*Primary Examiner* — Javaid Nasri
(74) *Attorney, Agent, or Firm* — Muncy, Geissler, Olds & Lowe, PLLC

(57) ABSTRACT

A protection system for a connector that comprises two connector elements (1, 2) provided with open ends that are mutually engagable one in the other along an engagement direction, the system comprising first and second shutters (11, 21), each connected to a respective one of the open ends via a laterally-offset hinge (12, 22) of axis parallel to the engagement direction, in such a manner that each shutter can be pivoted between a position in which it shuts the corresponding open end and a position in which it disengages it, the shutters having respective front faces provided with means (17, 27) enabling them to be constrained to pivot together about the hinge axis, and the hinge of the first shutter being mounted on the corresponding end so as to be movable in translation parallel to the engagement direction between a position in which the shutter is flush with the open end and a position in which it is set back from the open end.

7 Claims, 3 Drawing Sheets

SYSTEM FOR PROTECTING THE ENGAGABLE ELEMENTS OF A CONNECTOR

The present invention relates to a protection system for protecting the engagable elements of a connector.

BACKGROUND OF THE INVENTION

It is difficult to clean a connector that has become covered in mud because access to certain portions of the connector is very restricted. Mud interferes with the mechanical and electrical operation of a connector.

In order to protect the engagable elements of a connector against mud, regardless of whether mud has been splashed onto the connector element or the connector element has been immersed in mud, proposals have been made to place a stopper on the connector element, or to provide a piston that is incorporated in the connector element and that is urged by a spring into a position in which the piston surrounds the connection members of the connector element so as to fill the space between the connection members and thus prevent mud from penetrating between the connection members.

Those techniques are not satisfactory. When a stopper is used to protect the connector element, it is necessary to remove the stopper when using the connector element to make a connection with another connector element. There is a risk that the user will forget or fail to put the stopper back into place, e.g. for lack of time. The stopper also runs the risk of being lost, or if it is attached to the connector element, it runs the risk of receiving mud or of dropping into the mud, so that it can no longer be used to reclose the connector element. With a piston, there is a risk of mud accumulating in the interstices between the connection members and the piston so that it rapidly becomes impossible to move the piston and thus disengage the connection members. Piston systems have the drawback of being complex and of requiring a connector to be relatively long, thereby making it more difficult to install, e.g. for mounting on the wall of a piece of equipment.

OBJECT OF THE INVENTION

An object of the invention is to provide a protection system that is relatively compact, that is easy to handle, and that provides effective protection.

SUMMARY OF THE INVENTION

In order to achieve this object, the invention provides a protection system for a connector that comprises two connector elements provided with open ends that are mutually engagable one in the other along an engagement direction, the system comprising a first and second shutters, each connected to a respective one of the open ends via a laterally-offset hinge of axis parallel to the engagement direction, in such a manner that each shutter can be pivoted between a position in which it shuts the corresponding open end and a position in which it disengages it, the shutters having respective front faces provided with means enabling them to be constrained to pivot together about the hinge axis, and the hinge of the first shutter being mounted on the corresponding end so as to be movable in translation parallel to the engagement direction between a position in which the shutter is flush with the open end and a position in which it is set back from the open end.

The shutters are constrained to pivot together before engagement of the connector element takes place by bringing the front faces of the shutter into contact, after which they can be pivoted simultaneously immediately prior to making the engagement. The shutters thus become disengaged at a moment when the open ends are spaced apart by a distance that is equal to the sum of the thicknesses of the shutters, and for a very short length of time, thereby limiting the risk of dirt penetrating into the open ends of the connector element. Moving the first shutter into its set-back position enables the open ends of the connector elements to be moved one into the other and then engaged. Thus, the shutter remains permanently attached to the connector element that it protects and therefore it does not run the risk of being lost, and it is opened at the moment of engagement with another connector element.

In an advantageous version of the invention, the system includes at least one return member for each of the shutters for returning the shutter to its shut position.

The shutters are thus returned to their shut positions as soon as disconnection takes place.

Under such circumstances, and preferably, the return member of the first shutter is a helical spring mounted to work in compression so as to take the shutter from the set-back position towards its flush position and to work in twisting so as to return the shutter from its disengaged position towards its shut position.

The spring then performs two functions, a return function in pivoting and a return function in translation.

BRIEF DESCRIPTION OF THE DRAWINGS

Other characteristics and advantages of the invention appear on reading the following description of a particular and non-limiting embodiment of the invention.

Reference is made to the accompanying figures, in which.

DETAILED DESCRIPTION OF THE INVENTION

Figure 1:
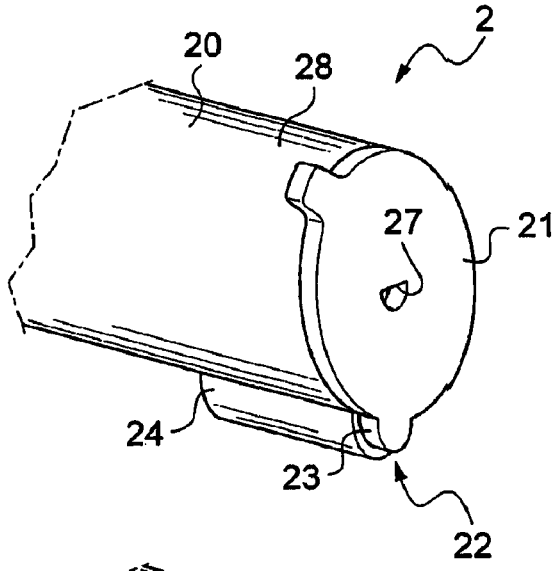
FIG. 1 is a perspective view of a protective sleeve of the invention in the shut position.
Figure 2:
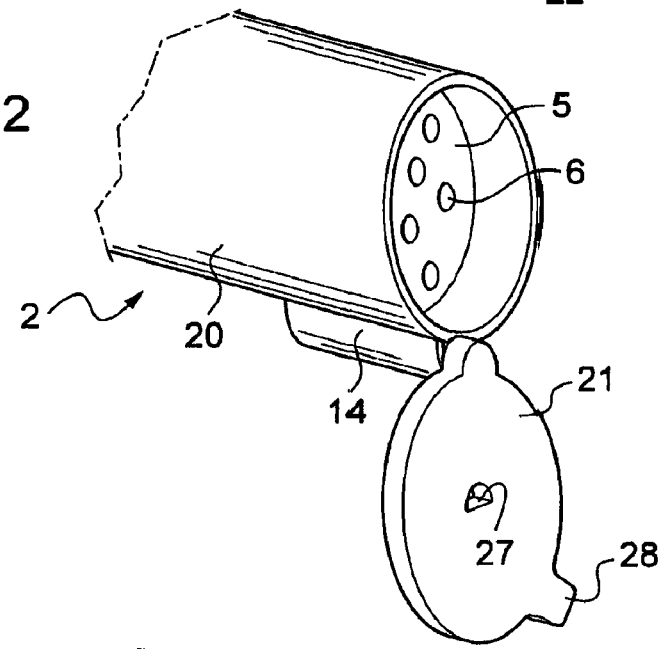
FIG. 2 is a perspective view analogous to FIG. 1 showing the sleeve in an open position.

With reference to FIGS. 1 to 7, the protection system of the invention is for protecting a connector comprising two engagable connector elements 1 and 2. In the embodiment described, the connector element 2 includes a cylindrical bushing 4 of circular section that is for fastening to the end of a cable and that contains a connector member 5 having metal-plated holes 6 connected to connection wires. The connector element 1 includes a cylindrical bushing 7 of circular section for mounting on the end of a cable and that contains a connector member 8 fitted with pins 9 that coincide with the metal-plated holes 6.

Each connector elements 1 and 2 includes a respective cylindrical sleeve 10 or 20 having an open end that projects respectively from the entry orifices of the metal-plates holes 6 or from the free ends of the pins 9. The sleeves 10 and 20 are arranged to be suitable for engaging one in the other in an engagement direction in such a manner as to enable the pins 9 to penetrate into the metal-plated holes 6.

The open ends of the sleeves 10 and 20 are provided with respective shutters 11 and 21 of disk-shape, each shutter being connected to its sleeve 10, 20 via a respective hinge, given overall reference 12, 22, that is offset to one side and has its axis parallel to the engagement direction.

The hinges 12 and 22 comprise respective cylindrical pivots 13 and 23 extending from an edge of the corresponding shutter 11, 21 parallel to a direction that is normal to the shutter. Each pivot 13, 23 is pivotally received in a respective gutter 14, 24 extending along one of the sides of the corresponding sleeve 10, 20 such that the shutter 11, 21 can pivot between a shut position in which it shuts the open end of the sleeve 10, 20, and a disengaged position in which it disengages it. The gutter 14, 24 receives a respective spring 15, 25 for returning the corresponding shutter 11, 21 into the shut position. When the shutters 11, 21 are in the shut position, each of them is in contact with and rubs against the corresponding sleeve 10, 20.

In addition, the gutter 14 receives the pivot 13 slidably to slide parallel to the engagement position between a position flush with the open end of the sleeve 10 and a position set back from said open end, sliding taking place over a stroke that is not less than the engagement length of the two connector elements 1, 2 required for connecting them together while the shutter 11 is pivoted in its disengaged position.

The shutters 11 and 21 have front faces 16 and 26 that are provided with portions in relief 17 and 27 of complementary shapes so as to constrain them to pivot together about the hinge axis 12, 22 when the front faces 16 and 26 are in contact. The portions in relief 17 and 27 in this example are respectively a finger having a flat and projecting from the front face 16, and a recess of complementary shape formed in the front face 26. This performs a keying function making it necessary to bring the hinge axes into alignment in order to enable the shutters to pivot. This also makes it possible to bring the connector elements into alignment with each other prior to making the connection proper.

The shutter 21 also includes a lateral lug 28 making it easier to handle for pivoting from its shut position towards its disengaged position. In a variant, the shutter could have a plurality of lateral lugs or it could have a surface that is knurled or fluted.

Figure 3:
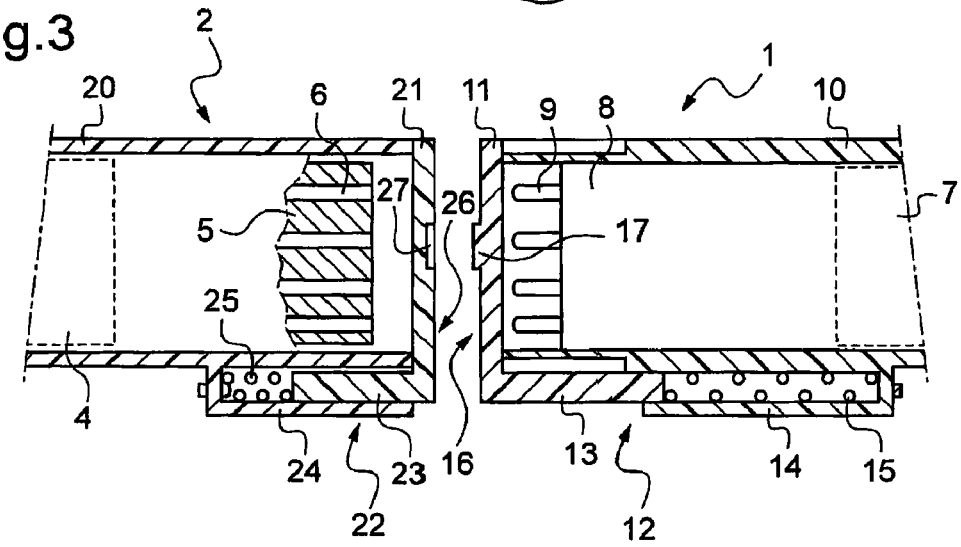
FIG. 3 is a diagrammatic section view on an axial plane of two cylindrical connector elements fitted with a protection system of the invention and placed facing each other prior to engagement.
Figure 4:
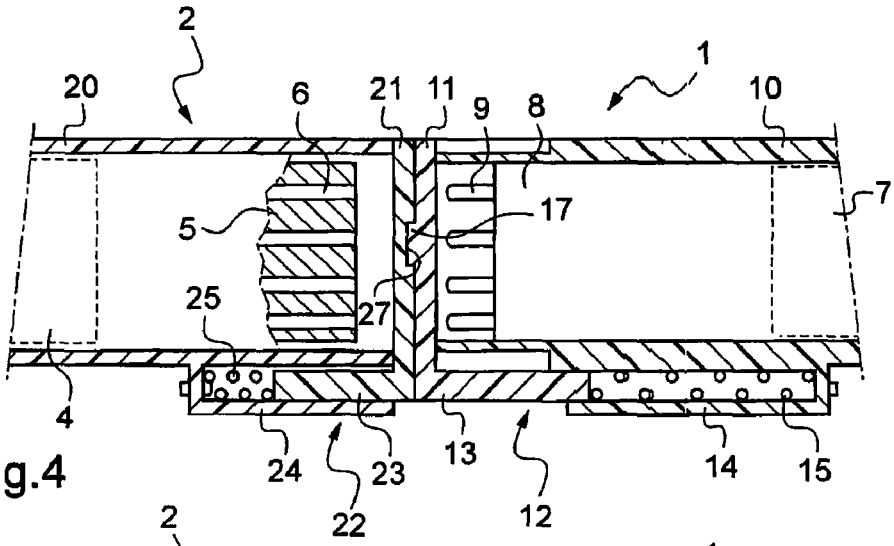
FIG. 4 is a view analogous to that of FIG. 3, during an intermediate stage of engagement.
Figure 5:
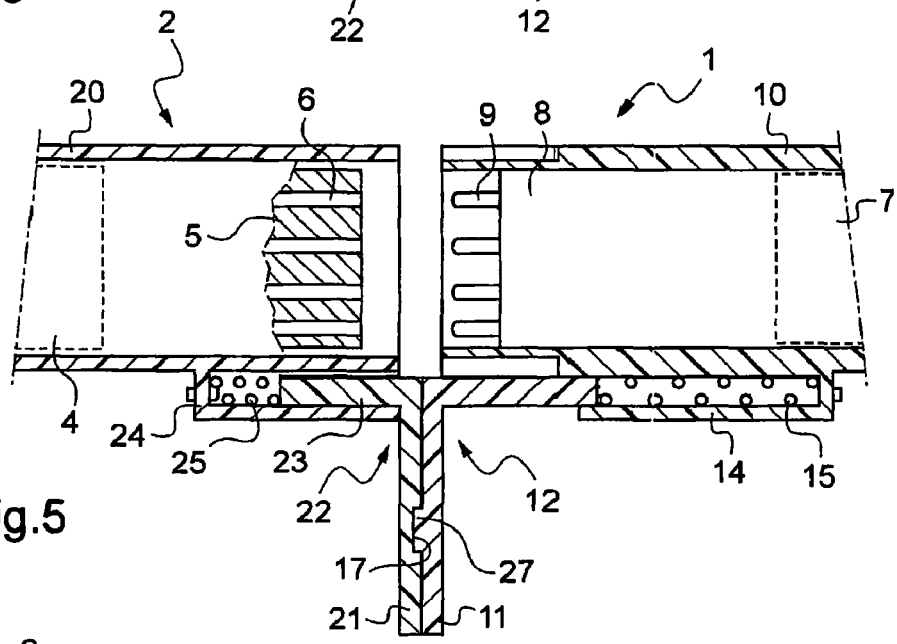
FIG. 5 is a view analogous to that of FIG. 3, during a second intermediate stage of engagement.
Figure 6:
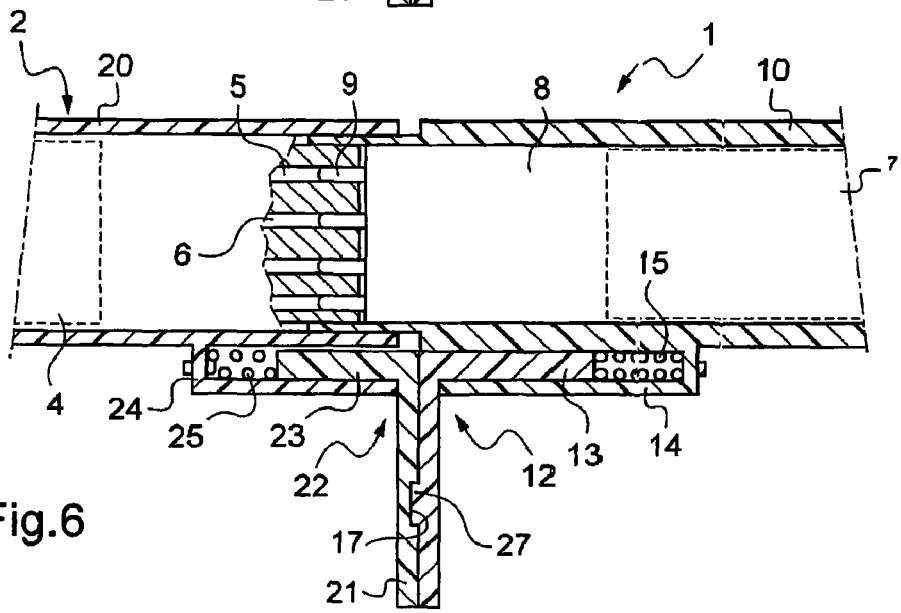
FIG. 6 is a view analogous to the view of FIG. 3, showing an engaged position of the connector element.

As shown in FIG. 3, when the connector elements 1 and 2 are separate, the sleeves 10 and 20 are closed in leaktight manner by the shutters 11 and 21. When it is desired to engage the connector elements 1 and 2, the front faces 16 and 26 of the shutters 11 and 21 while still in the shut position are presented to face each other so as to engage the finger 17 in the recess 27 and put the front faces 16 and 26 into contact with their hinge axes 12 and 22 coinciding. The lug 28 is then manipulated to cause the shutter 21 to pivot towards its disengaged position, taking with it the shutter 11 into its disengaged position by co-operation between the portions in relief 17 and 27 constraining the shutters 11 and 21 to move together (FIGS. 5 and 6). Thereafter, moving the connector elements 1 and 2 towards each other causes the sleeves 10 and 20 to engage one within the other, and the pins 9 to penetrate into the metal-plated holes 6, with the pivot 13 sliding in the gutter 14 so as to bring the shutter 11 into its set-back position where it does not impede making the connection (FIG. 6). It should be observed that the shutter 21 (now constrained to move with the shutter 11) provides a bearing surface for a finger of the operator, thereby making it easier to insert the sleeves one into the other and enabling the engagement force to be exerted on the connector element. Preferably, the inside and outside surfaces of the connector elements 1 and 2 and of the components that are attached thereto have coefficients of friction that facilitate relative sliding.

It should be observed that it is important that when the axes of rotation coincide, the sleeves, and the pins and the holes are likewise in alignment. This constraint is complied with during fabrication of the sleeves or when they are mounted on the connector elements.

While the connector elements 1 and 2 are being separated, the shutters 11 and 21 are returned towards their shut positions by the springs 15 and 25. It should be observed that the spring 15 begins by urging the shutter 11 in translation towards its flush position and then in rotation towards its shut position. The spring 25 serves only to urge the shutter 21 in rotation towards its shut position.

It should be observed that the gutter 14 has one end set well back from the open end of the sleeve 10 so as to enable the shutter 11 to move back into its set-back position. It would also be possible to provide a slot in the gutter 14 away from the sleeve 10 so as to make it possible, while making a connection, to pass both the portion connecting the shutter 11 to the pivot 13 and the portion connecting the shutter 21 to the pivot 23.

An abutment that is not shown in the figures prevents the shutter 11 from being lifted off the open end of the sleeve 10 under drive from the spring 15.

On their surfaces that are opposite to their front faces 16 and 26, the shutters 11 and 21 are preferably provided with deformable sealing elements so as to seal the contact between each of them and the corresponding sleeve 10 or 20.

Figure 7:
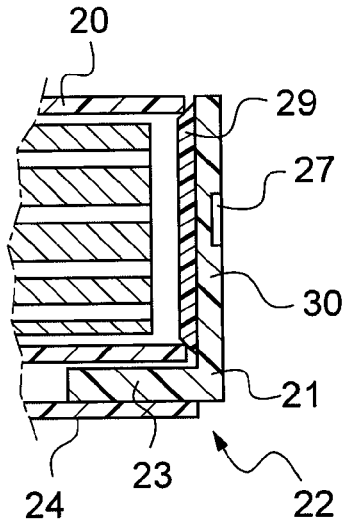
FIG. 7 is a detail view of a shutter of one of the connector elements.

With reference more particularly to FIG. 7, the shutter 21 comprises a disk 30 of rigid plastics material having fastened thereto a sealing element 29 of disk-shape with a chamfered edge and made of flexible elastomer. The sealing element 29 thus also serves to center the shutter 21 on the sleeve 20. The sealing element 29 is shown in FIG. 7 only, so as to avoid overcomplicating FIGS. 1 to 6. In a variant, the sealing element could be an O-ring or it could be in the form of a flattened hemisphere.

The shutters may also be rigid or semi-rigid, e.g. being made of an elastomer or any other non-fragile material.

Figure 8:
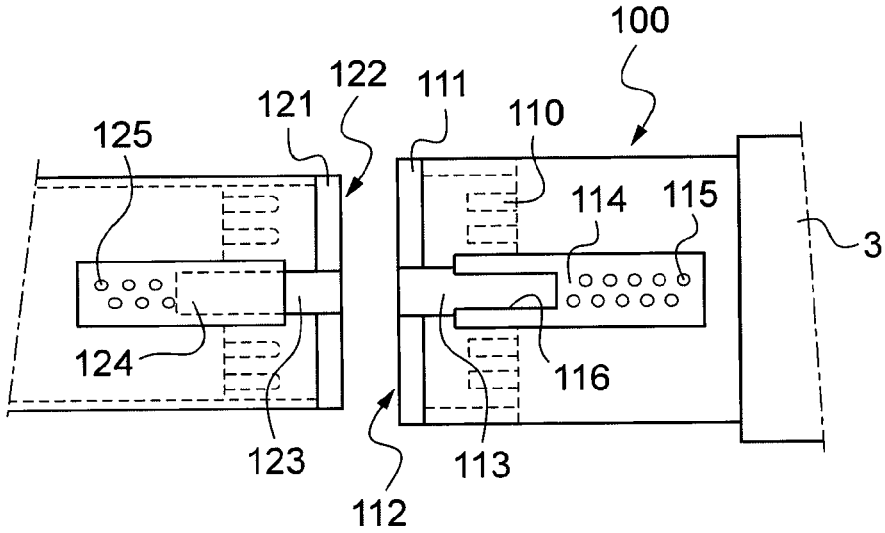
FIG. 8 is an elevation view of a connector element in a variant embodiment.
Figure 9:
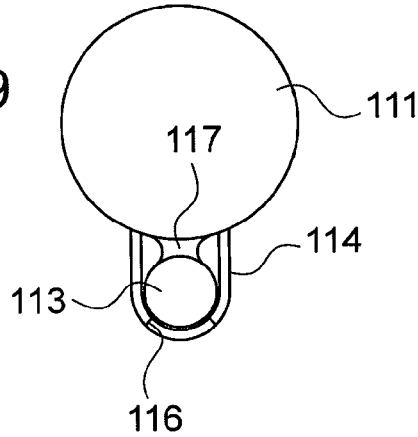
FIG. 9 is an end view of the FIG. 8 connector element.

In a variant, as shown in FIGS. 8 and 9, the connector element 100 includes a base 3 for fastening to a wall of apparatus (not shown) and a cylindrical bushing of circular section that is fastened to the base 3 and that contains a connection member having metal-plated holes that are connected to connection wires.

The connector element 100 has a sleeve 110 provided with a shutter 111 that is connected to the sleeve 110 by a hinge 112 having a pivot 113 that is pivotally and slidably received in a gutter 114 extending along the sleeve 110 and receiving a return spring 115. The components 110, 111, 112, 113, 114, and 115 function in the same manners as the components 10, 11, 12, 13, 14, and 15. The gutter 114 has a longitudinal slot 116 for slidably receiving the portion 117 that rigidly connects the shutter 111 to the pivot 113. This enables the gutter 114 to have a relatively long length for guiding the pivot 113.

The connector element 100 is arranged to co-operate with a connector element of the type represented by a connector element 200 that comprises a bushing containing a connection element provided with pins for engaging in the metal-plated holes.

A sleeve 120 surrounds the bushing. The sleeve 120 is provided with a shutter 121 that is connected to the sleeve 120 by a hinge 122 comprising a pivot 123 received together with a return spring 125 in a gutter 124 in the same manner as the above-described sleeve 20 and shutter 21.

The connector elements 100 and 200 are connected together in a manner analogous to the connector elements 1 and 2.

The invention is not limited to the embodiments described, and variant embodiments can be provided without going beyond the ambit of the invention as defined by the claims.

In particular, the sleeves 10 and 20 may be formed integrally with the connector elements 1 and 2 or they may be fitted thereto and fastened either releasably by snap-fastening or adhesive, or permanently by welding or by being molded thereon.

Although the return spring of the shutter 11 serves to perform a return function both in pivoting and in translation, it is possible to use two springs each dedicated to only one of the return functions.

The springs are optional and means could be provided for retaining the shutters in their respective positions, e.g. by snap-fastening. Other types of spring could be used, and for example hairpin springs for rotary return (it being possible for the hairpin spring to be partially embedded in the shutter) or a deformable elastomer for return in translation. In addition, helical springs may be mounted around the pivots rather than at the free ends thereof.

In order to encourage relative sliding of the bushings and/or sleeves, their surfaces that come into contact may be covered in polytetrafluorethylene (PTFE) or the like. For this purpose, it is possible to use a PTFE tape that can also act as a stiffener for the element on which it is fastened.

The portions in relief 17 may be of a shape different from that described, for example a shape that is symmetrical, and it is also possible to have a plurality of portions in relief in a non-symmetrical configuration. Examples of possible shapes are as follows:

three peripheral studs; and a stud at the end of the pivot and a stud on an opposite portion of the shutter.

Regardless of the shape or the configuration of the studs, the cavities corresponding thereto are preferably of a shape that makes it easy to remove dirt when inserting the studs, e.g. a flared shape.

What is claimed is:

1. A protection system for a connector that comprises two connector elements (1, 2) provided with open ends that are mutually engagable one in the other along an engagement direction, the protection system comprising first and second shutters (11, 21), each connected to a respective one of the open ends via a laterally-offset hinge (12, 22) of axis, in such a manner that each shutter can be pivoted between a position in which it shuts the corresponding open end and a position in which it disengages it, wherein:

the axis of hinge of each shutter is parallel to the engagement direction;

the shutters have respective front faces provided with means (17, 27) enabling them to be constrained to pivot together about the hinge axis;

the hinge of the first shutter is mounted on the corresponding end so as to be movable in translation parallel to the engagement direction between a position in which the shutter is flush with the open end and a position in which it is set back from the open end.

2. A system according to claim 1, including at least one return member (14, 24) for each of the shutters (11, 21) for returning the shutter to the shut position.

3. A system according to claim 2, wherein the return member of the first shutter (11) is a helical spring (15) mounted to work in compression so as to take the shutter from the set-back position towards its flush position and to work in twisting so as to return the shutter from its disengaged position towards its shut position.

4. A system according to claim 1, wherein the hinge (12) of the first shutter (11) includes a pivot (13) offset to one side of the first shutter and pivotally and slidably received in a gutter secured to the corresponding open end.

5. A system according to claim 4, wherein the gutter (114) includes an axial slot (115) slidably receiving a portion (117) connecting the shutter (111) to the pivot (113).

6. A system according to claim 1, wherein the shutters (11, 21; 111, 211) are made of a non-brittle material such as an elastomer.

7. A system according to claim 1, wherein the shutters (11, 21; 111, 211) have inside faces provided with respective sealing elements (29) for providing leaktight contact between the shutter in the shut position and the open end of the connector element.

* * * * *